US005446634A

United States Patent [19]

Okubo

[11] Patent Number: 5,446,634

[45] Date of Patent: Aug. 29, 1995

[54] CONSTRUCTION MATERIAL

[76] Inventor: Shiroshi Okubo, Suita, Japan

[21] Appl. No.: 106,704

[22] Filed: Aug. 16, 1993

[30] Foreign Application Priority Data

Aug. 17, 1992 [JP] Japan ..... 4-063302 U

[51] Int. Cl.[6] ..... E04C 1/420

[52] U.S. Cl. ..... 362/147; 362/806; 362/812; 362/263; 362/362; 40/545

[58] Field of Search ..... 362/253, 806, 812, 216, 362/147, 362, 263; 40/541, 545

[56] References Cited

U.S. PATENT DOCUMENTS

| | | | |
|---|---|---|---|
| 2,116,220 | 10/1940 | Baker | 362/147 |
| 2,852,877 | 9/1958 | Goebel et al. | 40/545 |
| 4,754,380 | 6/1988 | Wang | 362/812 |
| 5,006,967 | 4/1991 | Diamond | 362/147 |
| 5,036,243 | 7/1991 | Cocks et al. | 362/812 |
| 5,270,910 | 12/1993 | Kite | 362/216 |
| 5,295,050 | 3/1994 | Helstern et al. | 362/812 |

FOREIGN PATENT DOCUMENTS

| | | | |
|---|---|---|---|
| 0297583 | 12/1990 | Japan | 40/541 |

*Primary Examiner*—Ira S. Lazurus

*Assistant Examiner*—Sara Sachie Raab

*Attorney, Agent, or Firm*—Armstrong, Westerman, Hattori, McLeland & Naughton

[57] ABSTRACT

A construction member includes an external frame portion made of polycarbonate resin with connection holes formed along its periphery. The front face of the external frame portion has attached thereto a freely removable panel made of, for example, a first plate of transparent glass having a concave portion and a flat second plate. Between the first plate and the second plate there is formed a continuous hollow portion, which, as a figure plate, contains a letter, pattern, or the like. The continuous hollow portion is charged with, for example, neon gas and has attached thereto two electrode tubes. The external frame portion has formed therein, at a distance from the panel, a partitioning member containing a reflective sheet freely removably attached to the surface thereof formed, for example, of aluminum foil or synthetic resin film. The continuous hollow portion is luminous as a voltage is applied to two electrode tubes and the image emitted is reflected by the reflective sheet. The external frame portion has a freely removable back lid on its rear side.

5 Claims, 10 Drawing Sheets

CONSTRUCTION MATERIAL

BACKGROUND OF THE INVENTION

1. Field of the Invention

The present invention relates to a construction member and more particularly to a construction member used, for example, in floors, walls, ceilings, and the like, as interior finish members and an exterior wall finish.

2. Description of the Prior Art

Hitherto, construction members serving as interior finish members and an exterior wall finish included, among other things, wood boards, stone materials, gypsum boards, artificial stones, bricks, ceramic tiles and plastic tiles.

Such conventional construction members, however, had their surfaces generally flat, and were lacking in general decorativeness. Only a few thereof were aesthetically variable.

The conventional construction members, in general therefore, could not meet the diverse needs of users as materials for buildings in, for example, city zones and commercial zones; or those in play zones, such as theme parks, waterfront constructions and various resort facilities; or as formative materials for enhancing visual effects for various events; and interior finishes.

SUMMARY OF THE INVENTION

It is, therefore, a primary object of the present invention to provide a construction member, as a new formative material, that is rich in decorativeness, as well as in producing visual effect.

The present invention is directed to a construction member comprising a shaped external frame portion having connection holes about its periphery, a panel presenting on its proximal side a letter, pattern, or the like, a partition member having a reflective sheet with its surface material reflecting light, and an illuminating means for illuminating the decorative panel. A plurality of these construction members can be connected by means of the connection holes and a unit system can thus be formed. According to one aspect of the invention, a plurality of external frame portions can be connected by means of the connection holes using such fixing means as bolts or screws. The visually perceptible part is created by means of an illuminating means and a letter, pattern, or the like, in the visually perceptible part is illuminated by means of the emitting means and is reflected on the surface of the reflective sheet. Hence, with this kind of construction member a three-dimensional image, rich in the sense of depth, can be produced through overlapping of the visually perceptible part.

According to the present invention, a novel construction member as a new formative material with good decorativeness and excellent in producing visual effects is obtainable.

The above and other objects, features and advantages of the present invention will become more apparent from the following detailed description made with reference to the drawings.

DESCRIPTION OF THE PREFERRED EMBODIMENT

Figure 1A:
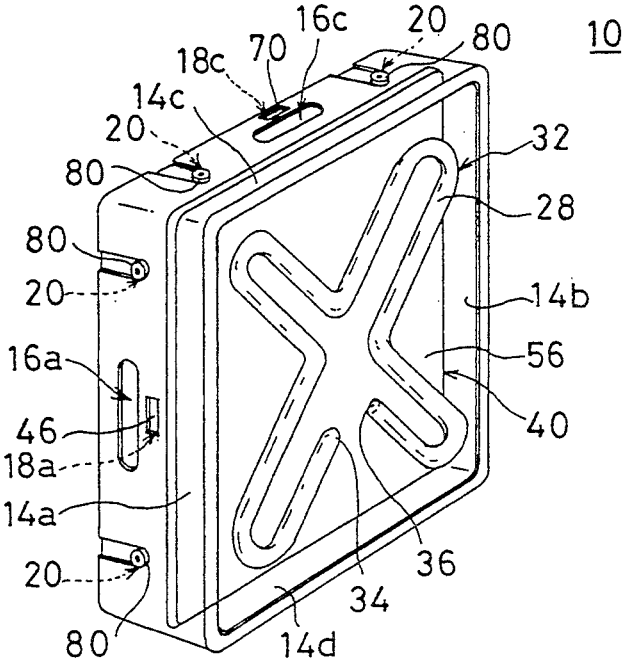
FIG. 1(A) is a perspective view showing an embodiment of the present invention.
Figure 1B:
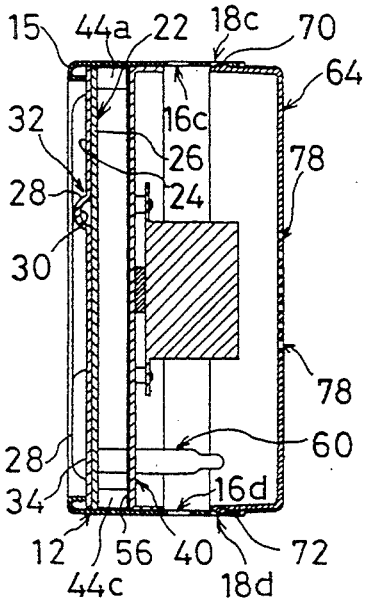
FIG. 1(B) is a longitudinal cross-sectional view taken along line B—B at the center of FIG. 1(A)
Figure 1C:
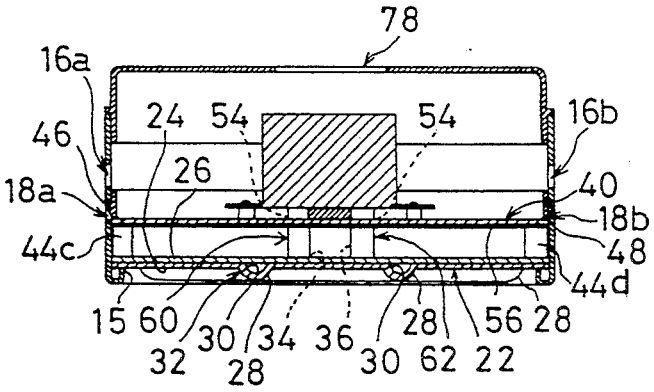
FIG. 1(C) is a transverse cross-sectional view taken along line C—C at the center of FIG. 1(A).
Figure 2:
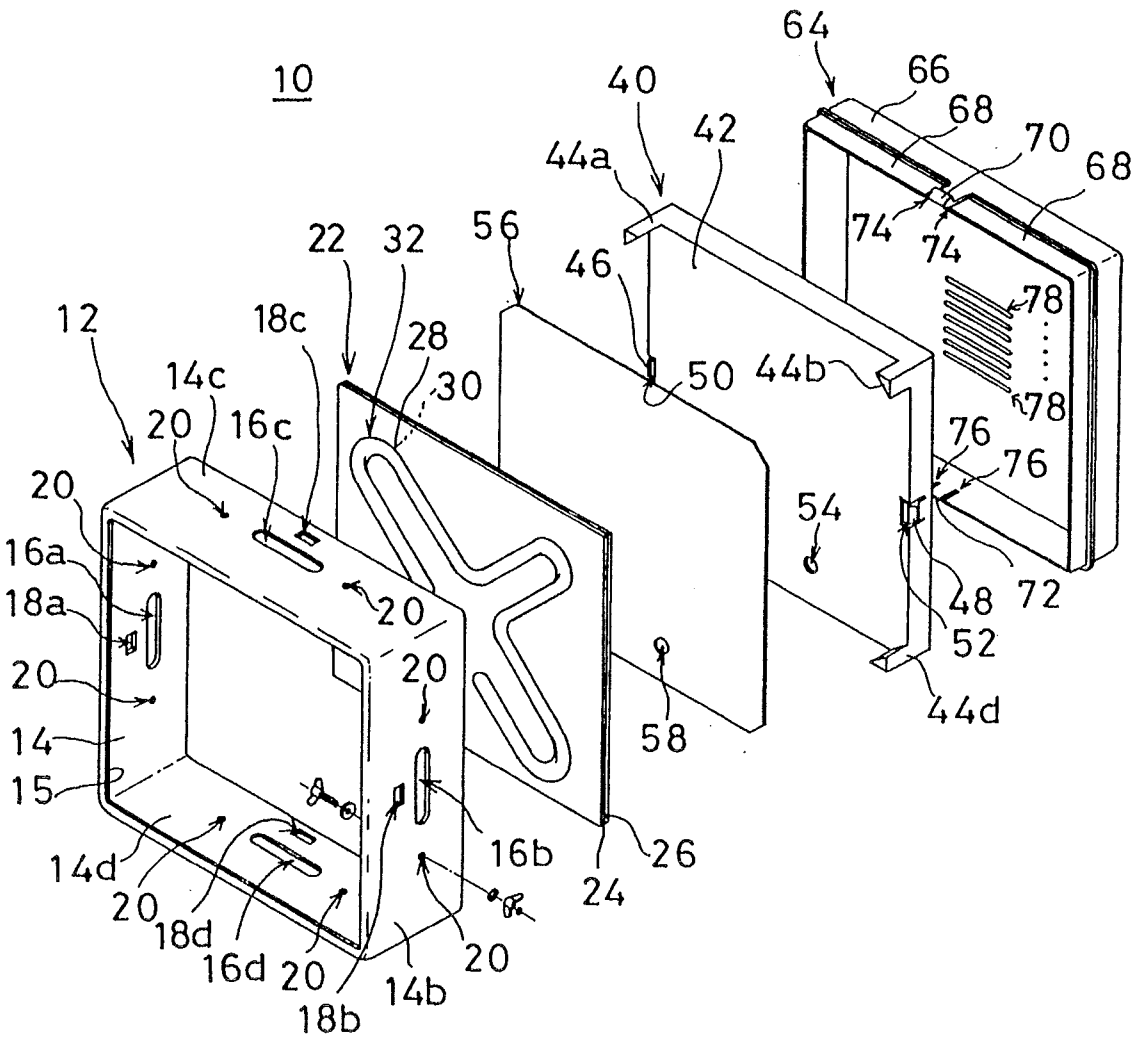
FIG. 2 is an exploded perspective view of the construction member shown in FIGS. 1(A).

FIG. 1(A) is a perspective view showing an embodiment of the present invention, FIG. 1(B) is a longitudinal cross section at the center of FIG. 1(A) and FIG. 1(C) is a transverse cross section at the center of FIG. 1(A). FIG. 2 is an exploded view of a construction member shown in FIG. 1(A).

This construction member 10 includes an external frame portion 12 having, for example, a rectangular profile. The external frame portion 12 is formed of, for example, four integrated rectangular side panels 14*a*, 14*b*, 14*c* and 14*d*. The periphery of either opening end of this external frame portion 12 is formed, for example, as a square having an edge 15 which is U-shaped in cross section, as shown in FIG. 1(B) and FIG. 1(C). The U-shaped section of this edge 15 is filled with caulking material as necessary (not shown).

The four side panels 14*a*–14*d* are formed, for example, of transparent or translucent polycarbonate resin and the square-shaped external frame portion 12, as shown in FIG. 1(A), FIG. 2, et cetera, are formed, for example, by injection molding such side panels 14*a*–14*d*. Alternatively, the external frame portion 12 may be formed of, beside polycarbonate resin, other flame retardant resin material or aluminum alloy.

In the four side panels 14*a*–14*d*, for example, elongated oval-shaped wiring holes 16*a*, 16*b*, 16*c* and 16*d* are formed at the center in the longitudinal direction, as well as in the transverse direction. The wiring holes 16*a*–16*d* are so arranged that the direction of the major axis is perpendicular to the width direction of the individual side panels 14*a*–14*d*. These wiring holes 16*a*–16*d* are for wiring the lead wires connected to the electrode tubes described below. In the four side panels 14*a*–14*d* are also formed rectangular stopper holes 18*a*, 18*b*, 18*c* and 18*d* adjacent and parallel to the wiring holes 16*a*–16*d* at a distance therefrom. The individual stopper holes 18*a*–18*d* are respectively formed with their central points on the extended line of the minor axis of the respective wiring holes 16*a*–16*d*. In this case, the stopper holes 18*a* and 18*b* are each formed between the laterally adjacent end edge (front edge) of the side panels 14*a* and 14*b* and the respective wiring holes 16*a*and 16*b*. The stopper holes 18*c* and 18*d*, on the other hand, are formed between the other edge (rear edge) of the side panels 14*c* and 14*d* and the respective wiring holes 16*c* and 16*d*. These stopper holes 18*a*–18*d* are for receiving the stopper pieces 46, 48, 70 and 72 of the partitioning member 40 described below.

Further, each of the four side panels 14*a*–14*d* have formed therein two substantially circular longitudinally spaced connection holes 20. In this case, the respective connection holes 20 are disposed on opposite sides of the respective wiring holes 16*a*–16*d* in substantial alignment with the longitudinal axis thereof.

At the front end of the external frame portion 12 there is attached, for example, a square panel 22, as shown in FIG. 1(A), FIG. 1(B), FIG. 1(C) and FIG. 2. This panel 22 is inserted through an opening in the rear end side of the external frame portion 12 until the edge of the panel 22 comes into abutting contact with the U-shaped edge 15.

The panel 22 includes, for example, a laminate of a first square plate 24 and a second square plate 26. The first plate 24 and the second plate 26 are formed of equal dimensions, 2.5 mm in thickness. These first and second plates, 24 and 26, are made of a transparent glass material and are joined, for example, by fusion under heating. The first plate 24 and the second plate 26 may, alternately, be joined by glass solder.

The first plate 24 in the described embodiment has formed as a visually perceptible part on one surface thereof a convex portion 28 having a substantial X-shape. This convex portion 28 is substantially semi-circular in section and is formed by expanding the first plate 24 from the other surface toward the one surface. The other surface of the first plate 24 has formed thereon a concave portion 30 corresponding to the convex portion 28. Meanwhile, the second plate 26 has both of its opposed surfaces formed flat.

The panel 22 is formed by combining the first plate 24 with the second plate 26 so that the other surface of the first plate 24 is joined fast to one surface or the other surface of the second plate 26. This panel 22 is passed through the opening in the rear end side of the external frame portion 12 with one surface of the first plate 24 in contact with the edge portion 15.

Hence, the panel 22 formed by the combination of a first plate 24 and a second plate 26 has formed between the first plate 24 and the second plate 26 a continuous hollow portion 32 having the substantial shape of the letter X. In this embodiment, the continuous hollow portion 32 is substantially X-shaped, but this continuous hollow portion may have some other shape, or be in the shape of some other letters. This continuous hollow portion 32 has a function of a discharge pass.

One end portion 34 and the other end portion 36 of the continuous hollow portion 32 are provided with electrode tubes 62 and 62, described below, as a means for illuminating the continuous hollow portion 32. This continuous hollow portion 32 has enclosed therein an inert gas such as neon, helium or argon. And through the voltage impressed between the electrode tubes 60 and 62, discharge phenomenon takes place in the continuous hollow portion 32 as a discharge pass and the continuous hollow portion 32 thus illuminates.

The external frame portion 12 has attached thereto a partitioning member 40. This partitioning member 40 includes a substantially square-shaped partition plate 42. At the four corners of one principal plane of the partition plate 42 substantially triangular prism-shaped arm pieces 44*a*, 44*b*, 44*c* and 44*d*. These arm pieces 44*a*–44*d* are extended perpendicularly from the four corners of the one surface of the partition plate 42.

As shown in FIG. 2, there are formed on the partition plate 42 two stoppers 46 and 48 substantially triangular in cross section. These stoppers 46 and 48, which are to be inserted into stopper holes 18*a* and 18*b* of the external frame portion 12, operate to affix the partitioning member 40 to the external frame portion 12.

One stopper piece 46 is formed at the center of one side edge of the partition plate 42 and the other stopper piece 48 is formed at the center of the other side edge of the partition plate 42. This means that one stopper piece 46 is formed at the center between the arm piece 44a and the arm piece 44*c* and the other stopper piece 48 is formed at the center between the arm piece 44*b* and the arm piece 44*d*. In this case, for example, a notch portion 50 of U-like configuration is provided at the center between the roots of the arm piece 44*a* and 44*c*. A similarly configured notch 52 is provided at the center between the roots of the arm piece 44*b* and the arm piece 44*d*. And the respective stopper pieces 46 and 48 are formed extending from the ends of the notches 50 and 52.

This partition plate 42 has formed therein two through holes 54, 54 for accommodating electrode tubes 60 and 62 corresponding to the respective ends 34 and 36 of the continuous hollow portion 32 of the panel 22. The partition plate 42, arm pieces 44*a*–44*d* and stopper pieces 46 and 48 are formed integrally by injection molding of, for example, polycarbonate resin or ABS (acrylonitrile-butadiene-styrene) resin.

A reflective sheet 56 is disposed on one surface of the partition plate 42 in the partitioning member 40. The reflective sheet 56 is made of, for example, aluminum foil or tinfoil, a resin film reflecting light, or a partially reflective "half mirror". In this embodiment, the reflective sheet 56 is formed by laminating, for example, aluminum foil on the surface of the partition plate 42 facing the front of the external frame portion 12 by means of, for example, an adhesive. The reflective sheet 56 may, as well, be formed by laminating on the surface of partition plate 42 a thermoplastic resin film such as of polyethylene or polypropylene by the use of an adhesive.

The reflective sheet 56 has made therein two holes 58, 58 corresponding to the two through-holes 54, 54 of the partition plate 42.

In this embodiment, the two through holes 54, 54 and the two holes 58, 58 are simultaneously formed by drilling at the locations of the one end portion 34 and the other end portion 36 of the continuous hollow portion 32 of the panel 22.

Meanwhile, the one end portion 34 and the other end portion 36 of the continuous hollow portion 32 of the panel 22 have respectively attached thereto electrode tubes 62, 62 through the two through-holes 54, 54 of the partition plate 42 and the two holes 58, 58 of the reflective sheet 56. These electrodes 60 and 62 are attached to a small lighting apparatus and a small transformer mounted on the back of the partitioning member 40 (not shown) by means of a lead wire (not shown). Further, the lead wires when connected extend from wiring holes 18*a*–18*d* and are connected to the outlet provided outside (not shown).

When more than five construction members are connected, a lighting apparatus high in capacity is used, hence a single lighting apparatus is provided outside the external frame portion 12 and the lead wires extending from the wiring holes 16*a*–16*d* of the individual units of construction member are connected to the lighting apparatus.

The external frame portion 12 has attached thereto a back lid 64 which includes a back lid body 66 having one side opened. This back lid 66 contains two reduced dimensional step portions 68 forming a rib 69 about the periphery of the open end. Also, the back lid body 66 has formed at the center of the upper edge portion between the step portions 68, a stopper piece 70 and at the center of the lower edge portion between the step portions 68 another stopper piece 72. These stopper pieces 70 and 72 are triangular in cross section. The stopper pieces 70 and 72 are adapted to be fitted in the stopper holes 18*c* and 18*d* as the back lid 64 is attached to the external frame portion 12.

In this case, two spaced slits 74, 74 are provided in the central part of the upper edge portion of the back lid 66 and thereby form the stopper piece 70 between the slits. Similarly, in the central part of the lower edge portion of the back lid body 66 two spaced slits 76, 76 are provided and thereby form a stopper piece 72 between the slits. In the central part of the back lid body 66 there are formed a plurality of vent holes 78, 78 . . . 78.

The back lid body 66 and the stopper pieces 70 and 62 are integrally formed by injection molding of polycarbonate resin, or the like.

As mentioned above, the construction member 10 shown in FIG. 1(A), FIG. 1(B), FIG. 1(C) and FIG. 2 are mainly composed of elements such as external frame portion 12, panel 22, partitioning member 40, electrode tubes 60, 62 and back lid 64. This construction member 10 is assembled by fitting the panel 22, partitioning member 40, electrode tubes 60, 62 and back lid 64 in the external frame portion 12 in this order from the back side thereof. These elements are freely removably attached to the external frame portion 12. Hence, in the assembly of this construction member 10 there is no need of bonding or screwing, thereby resulting in a labor saving in assembly work. With this construction member 10, therefore, assembly and disassembly are simple and the working efficiency is high.

With the construction member 10 of this embodiment a continuous hollow portion 32 is formed showing a substantially X-shaped pattern, as a visually perceptible part in the panel 22. In this continuous hollow portion 32, for example, neon gas is filled as an illuminating means and the electrode tubes 60 and 62 are mounted to one end portion 34 and the other end portion 36 of the continuous hollow portion 32. And as a voltage is applied between the electrode tubes 60 and 62 a glow discharge takes place in the continuous hollow portion 32, resulting in its illumination. The panel portion 22 has thereby presented thereon an X-like illuminant pattern.

Figure 3:
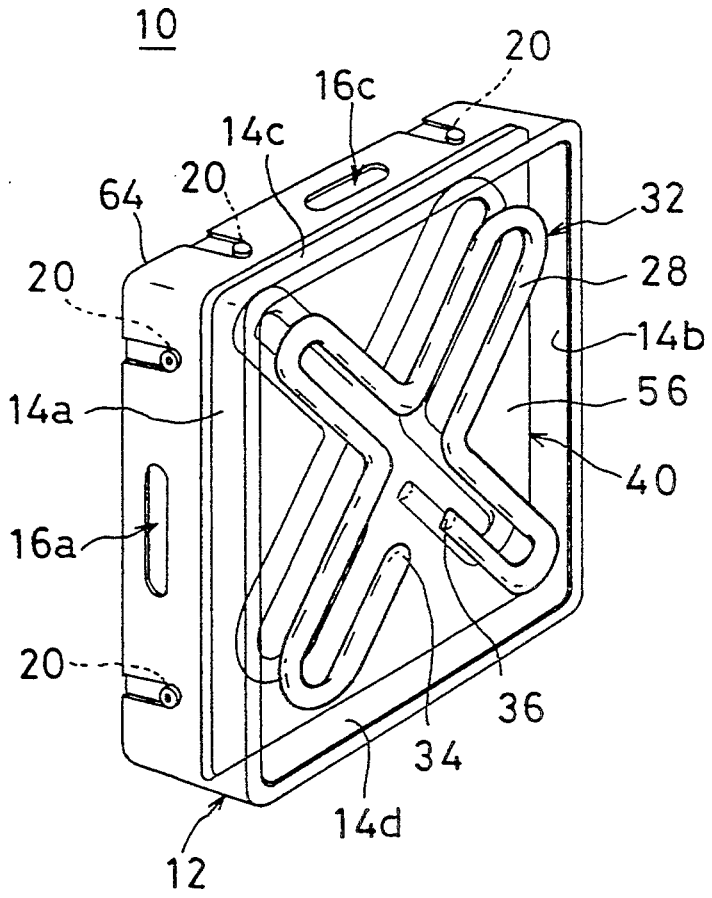
FIG. 3 is a perspective view illustrating the continuous hollow portion of the construction member shown in FIG. 1(A) in an illuminated condition.

Further, since in this construction member 10 the illuminant pattern in the continuous hollow portion 32 is reflected by a reflective sheet 56, as shown in FIG. 3, characteristic sharp light of the neon is effectively supported. Hence, in this construction member 10 the pattern of this continuous hollow portion 32 can be displayed three-dimensionally, as well as brilliantly.

Also, in this embodiment by placing, for example, a half mirror on the front side of the panel portion 22, the contours of the pattern of the continuous hollow portion 32 can be displayed in overlapped relation, thereby enabling the display of a still more three-dimensional and uniquely deep pattern.

Figure 4A:
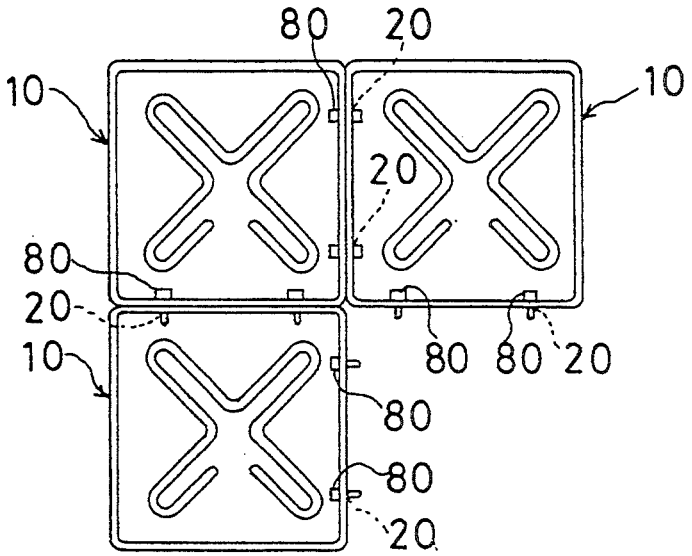
FIG. 4(A) is a schematic front view showing the construction material shown in FIG. 1(A) connected lengthwise and crosswise with relatively short bolts.
Figure 4B:
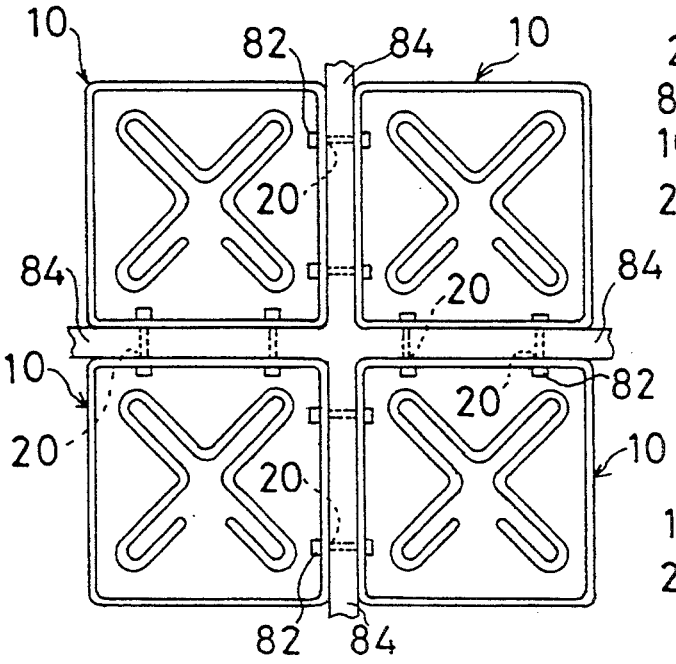
FIG. 4(B) is a schematic front view showing the construction member of FIG. 1(A) connected lengthwise and crosswise with relatively long bolts.
Figure 4C:
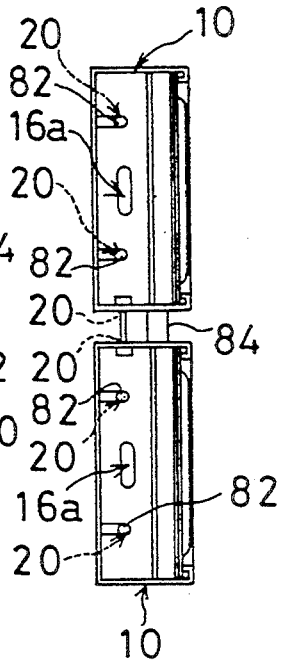
FIG. 4(C) is a schematic side view of FIG. 4(B).

These construction members 10 can be arranged in units as shown in FIG. 4(A), FIG. 4(B) and FIG. 4(C) and are easily connected lengthwise and breadth-wise by means of connecting means, for example, bolts, nuts, screws, and the like. When a plurality of construction members 10 are connected closely, relatively short bolts 80 may be set through the connection holes 20 of the individual construction material and nuts (not shown) may be screwed on securely.

When the construction members 10 are connected with wood, metal or other jointing materials 84 in between, it is possible to connect the members by setting relatively long bolts 82 through the connection holes 20 of the individual construction materials 10 and then having nuts (not shown) screwed thereon.

When a plurality of construction members 10 are connected in a construction work, the distance between the individual construction members can be increased or decreased by adjusting the length of the connection bolts.

Since, when a plurality of construction members 10 are connected, the lead wires connected to the electrode tubes 60, 62 are wired through the wiring holes 16*a*–16*d*, only few thereof are exposed. Hence, even if a plurality of construction members 10 of this kind are connected, it does not interfere with the aesthetic beauty, because most of the connection irregularities, if any, are invisible.

Figure 5:
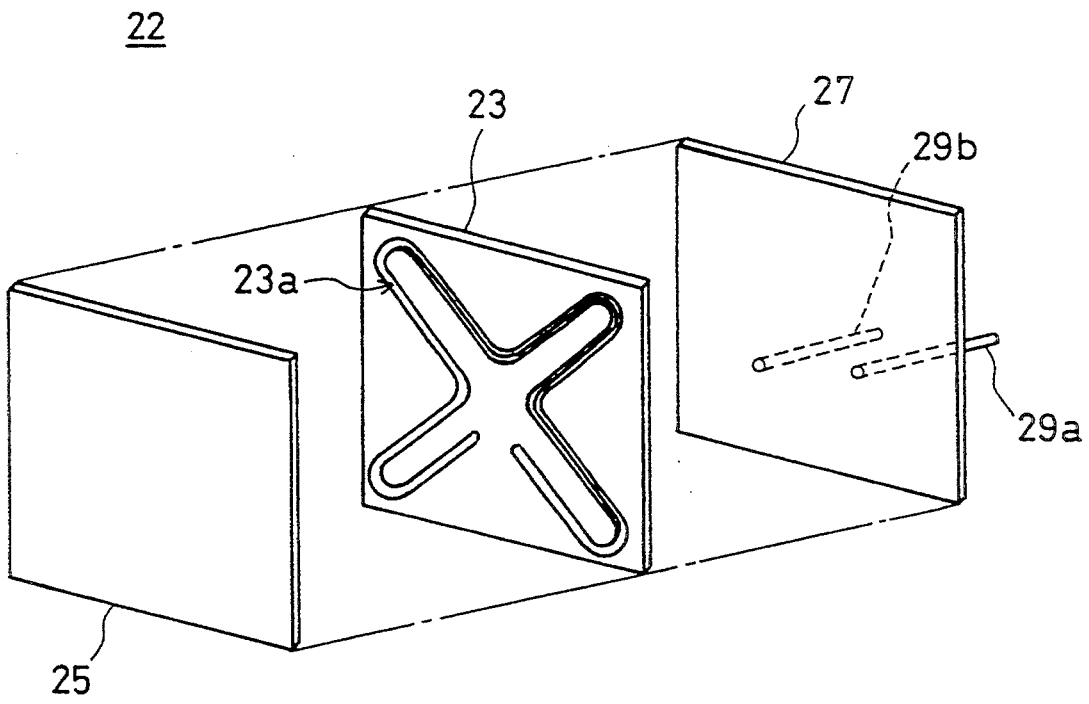
FIG. 5 is a view showing a modified embodiment of the present invention.

FIG. 5 is a view showing a modification of the embodiments in FIG. 1(A), FIG. 1(B), FIG. 1(C) and FIG. 2.

When this modification is compared with the embodiments of FIG. 1(A), FIG. 1(B), FIG. 1(C) and FIG. 2, particularly to be noted is that the panel 22 constituting a visually perceptible part is made up of a figure plate 23 and two flat plates 25, 27. That is, in the modification shown in FIG. 5, the panel 22 includes a figure plate 23 made of, for example, a transparent glass material. The figure plate 23 is, for example, formed in a square shape. This figure plate 23 has formed therein, for example, a continuous through-portion 23*a* in an X-form as a visually preceptible part. This continuous through-portion 23*a* is formed by stamping the X-like portion from one surface to the other surface of the figure plate 23. The dimensions of these flat plates 25 and 27 are equal to the dimensions of the figure plate 23, and are bonded to the figure plate 23 by e.g. glass solder.

Further, one flat plate 27 has affixed thereto electrode tubes 29*a* and 29*b*. In this case, the electrode tubes 29*a* and 29*b* are affixed to the positions corresponding to one end portion and the other end portion of the continuous through-portion 23*a* in the figure plate 23 when the flat plate 27 is connected to the figure plate 23.

In the panel 22 shown in FIG. 5, there is formed a continuous through-portion *23a* as the continuous hollow portion in an X-shaped pattern when one surface of the figure plate 23 and the other surface thereof have connected thereto the flat plates 25 and 27 respectively. That is, in the panel 22 shown in FIG. 5, the continuous through-portion *23a* is substantially identical with the continuous hollow portion, and this continuous hollow portion has a discharge function similar to that in the embodiments of FIG. 1(A), FIG. 1(B), FIG. 1(C) and FIG. 2. This continuous hollow portion has inert gas contained therein. And with a voltage applied between the electrode tubes *29a* and *29b*, discharge phenomenon takes place in the continuous hollow portion and, as a result, light is emitted in the continuous hollow portion to make it illuminant.

Figure 6A:
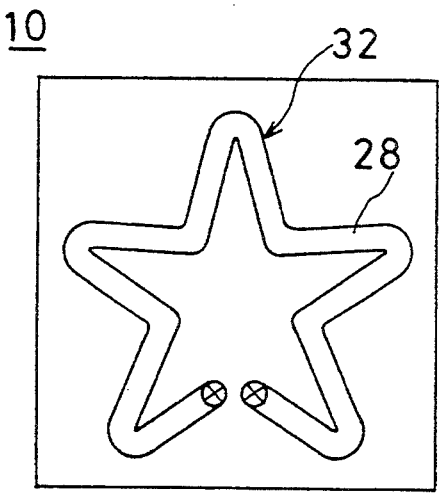
FIG. 6(A) is a schematic front view showing a second modified embodiment of the present invention.
Figure 6B:
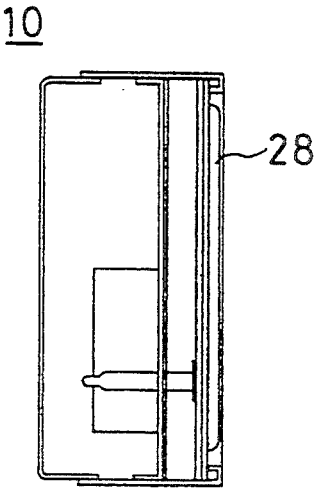
FIG. 6(B) is a schematic side view thereof.

FIG. 6(A) is a schematic front view showing another modification of the embodiment shown in FIG. 1(A), FIG. 1(B), FIG. 1(C) or FIG. 2 and FIG. 6(B) is a schematic side view thereof. In this modification embodiment, the continuous hollow portion 32 made in the panel 22 is of star-like configuration. The form of the continuous hollow portion 32 made in the panel 22 may thus be freely variable.

Figure 7A:
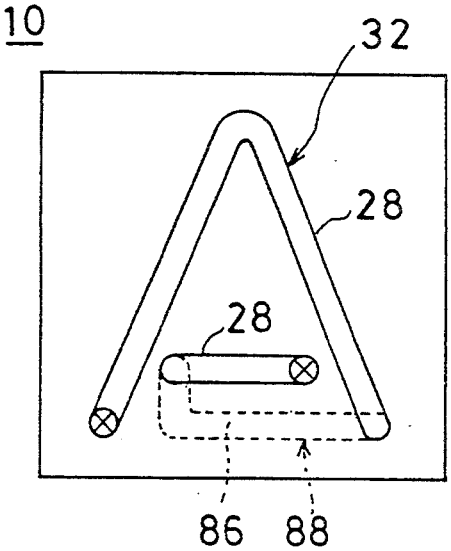
FIG. 7(A) is a schematic front view showing a third embodiment of the present invention.
Figure 7B:
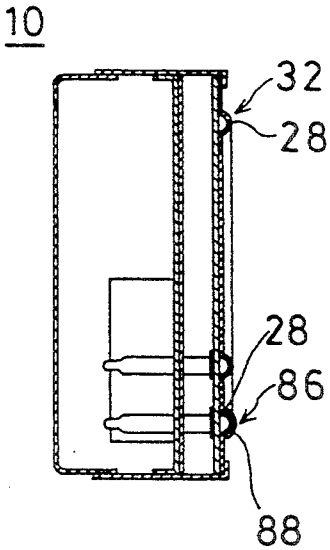
FIG. 7(B) is a schematic sectional view thereof.

FIG. 7(A) is a schematic front view showing another embodiment of the present invention and FIG. 7(B) is a schematic sectional view thereof.

In this embodiment, different from the embodiment shown in FIG. 1(A), FIG. 1(B), FIG. 1(C) or FIG. 2, the continuous hollow portion 32 in the panel 22 is, for example, A-shaped. The continuous hollow portion 32 has part thereof provided with a cover 86. And the surface of a convex-shaped part 28 of the cover 86 is covered with a reflective sheet 88. In this case, the reflective sheet 88 is made of the same material as the reflective sheet 56 formed on the surface of the partitioning plate 42.

Hence, the continuous hollow portion 32, as a result of the part covered with the cover 86, emits an A-like pattern and the light therefrom appropriately reflected to the reflective sheet 88 for light is shielded by the reflected sheet 88. Although in the embodiment shown in FIG. 7(A) and FIG. 7(B) the continuous hollow portion of the panel 22 is formed in A-shaped pattern, any of other letter or pattern may be freely selected.

FIG. 8, FIG. 9(A), FIG. 9(B), FIG. 10(A) and FIG. 10(B) are illustrations showing the possibilities of using such construction members according to the present invention.

Figure 8:
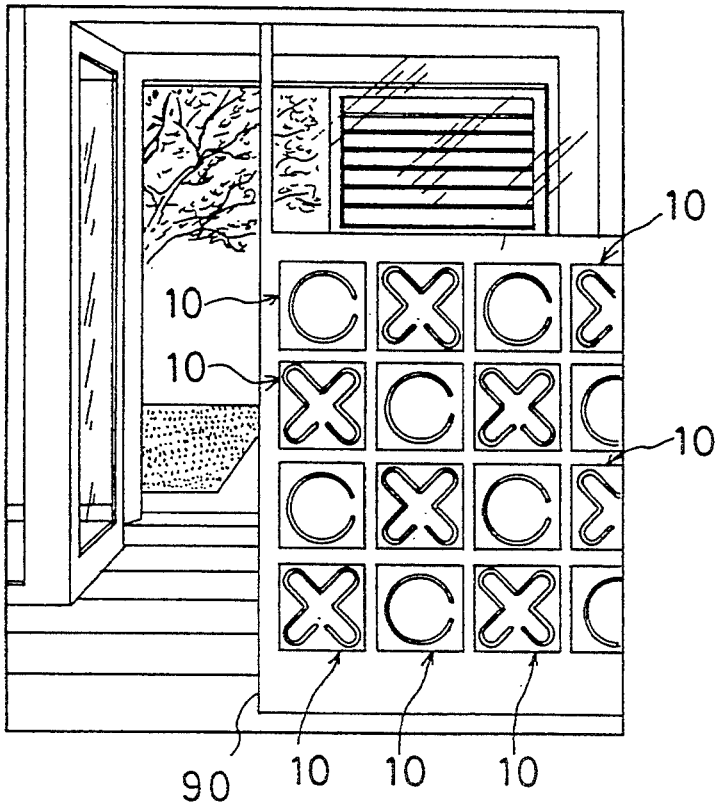
FIG. 8 is a view showing a construction in which examples of the members according to the present invention are used.

FIG. 8 shows a way of using this construction member as a room-partitioning panel. In this case, the partitioning panels 90 include construction members 10 shown in FIG. 1(A), FIG. 1(B), FIG. 1(C) and FIG. 2 and also other construction members provided with a continuous hollow portion 32 in a C-shaped pattern.

Figure 9:
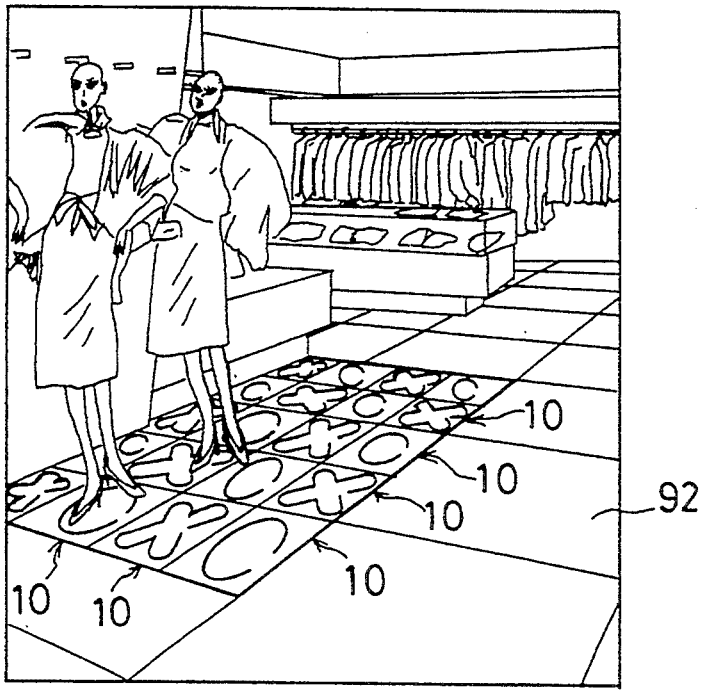
FIG. 9(A) is a view showing another use for the construction members according to the present invention.
FIG. 9(B) is a sectional view showing a state of installation.
Figure 9:
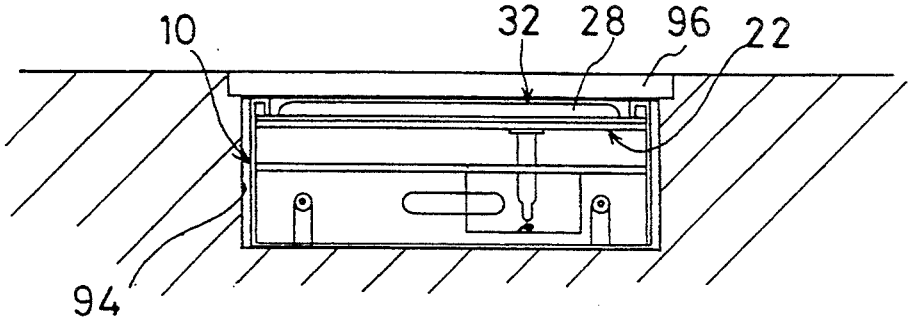

In FIG. 9(A) is shown a way of using such construction members as flooring 92 of a shopping center. In this case, this construction member 10 is embedded in a housing 94 provided by recessing the floor surface 29. This housing 94 is provided with a top protective plate 96 for protecting the panel 22. This protective plate 96 is made, for instance, of a reinforced hard glass or hard acrylic resin 10 mm, or so, in thickness and is effective for protecting the glass lest the continuous hollow molding portion 32 in the panel 22 be injured.

Figure 10A:
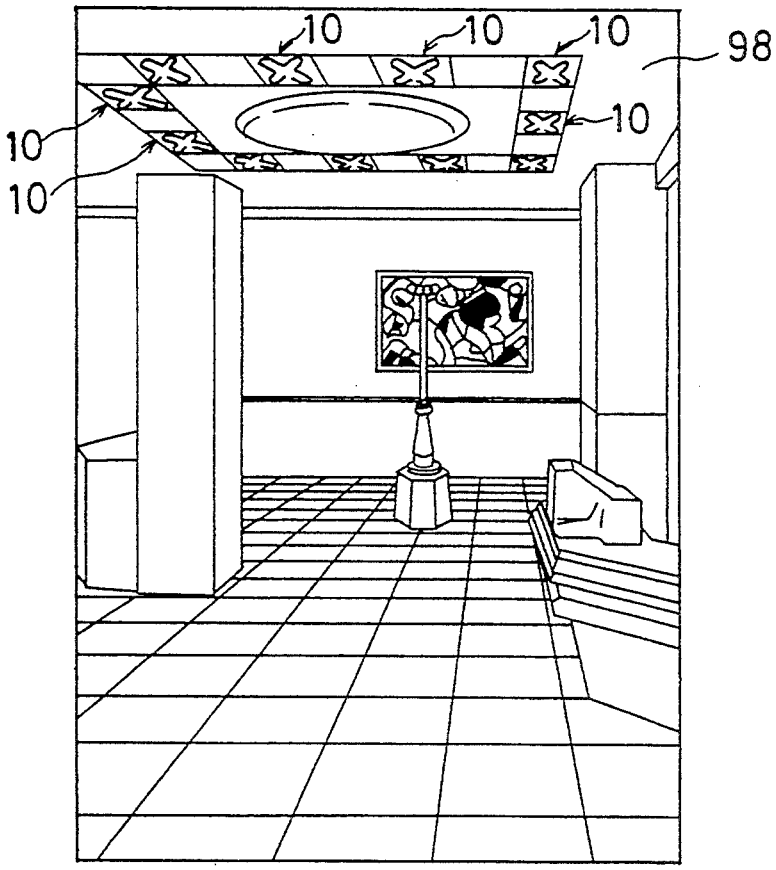
FIG. 10(A) is a view showing still another way of using a construction member according to the present invention.
Figure 10B:
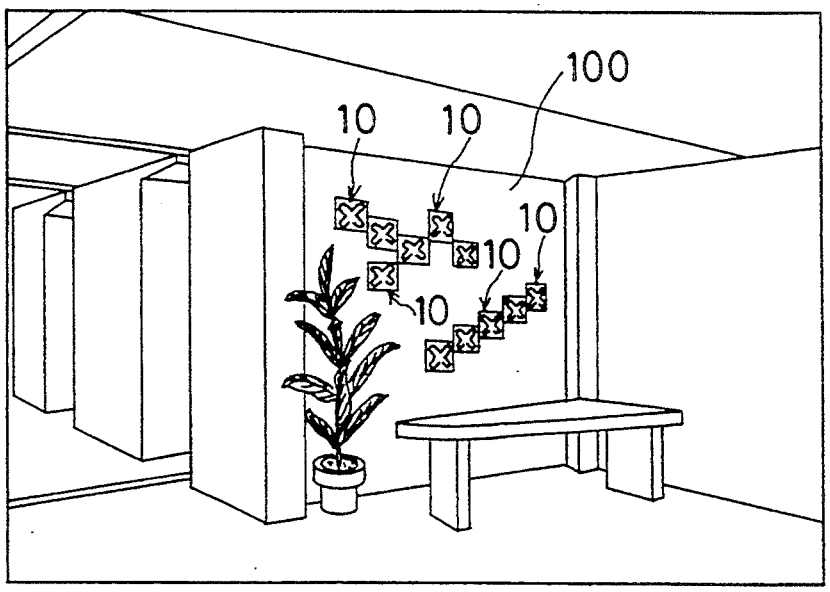
FIG. 10(B) is a view showing still a further way of using the construction member according to the present invention.
Figure 11A:
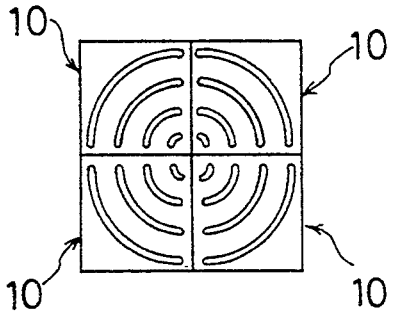
FIG. 11(A)–11(F) are schematic front views showing various patterns the construction members according to the present invention can employ.
Figure 11B:
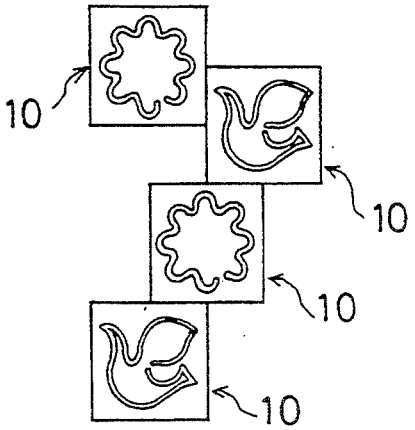
Figure 11C:
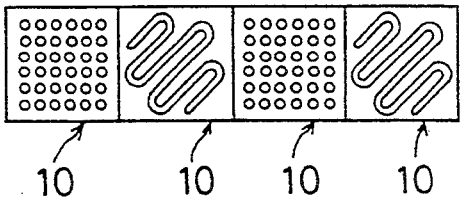
Figure 11D:
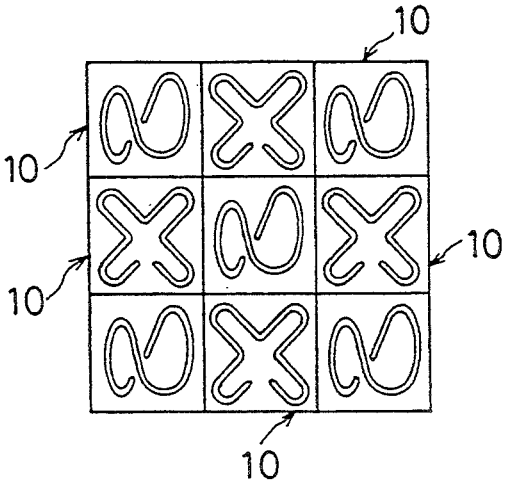
Figure 11E:
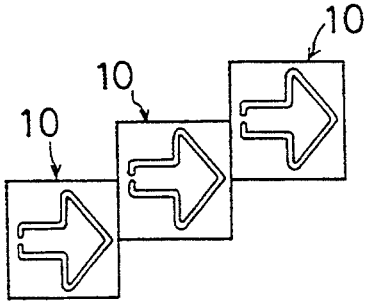
Figure 11F:
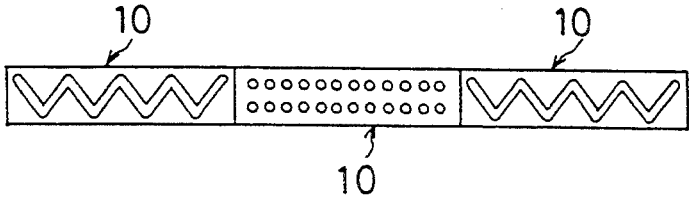

Further, in FIG. 10(A) the construction member 10 shown in FIG. 1(A), FIG. 1(B), FIG. 1(C) and FIG. 2 is used, for example, in a ceiling 98, while in FIG. 10(B) the same construction member is used for interior decoration of walls.

Thus, when the construction members 10 are used as flooring or ceiling materials, the emitted pattern of the continuous hollow portion 32 is reflected by the reflective sheet 56, thus giving rise to a sense emphasizing depth. Moreover, good harmony may be created between such construction members and the exterior of the building.

Further, when the construction member 10 according to the present invention is properly water-proof treated, such construction member may possibly be used as a bathtub lid or bathtub flooring.

The construction members, as shown in FIG. 11(A)–FIG. 11(F), may be used in combination for any desired pattern. In such a case, it is also possible to turn the light in the continuous hollow portion on and off by providing the switch for such construction member with a controller, or the like, thus creating light-flowing effects, even changing the color of light and bringing about effective visual effects rich in variation.

While the present invention has been particularly described as shown, it is to be understood that such description is used merely as illustration and example rather than limitation, and the spirit and scope of the present inventions determined solely by the terms of the appended claims.

What is claimed is:

1. A construction member comprising:

an external frame portion having connection holes formed along its periphery;

a panel removably attached to one side of said external frame portion, said panel having integrally formed on its surface a visually perceptible part in the form of a letter or pattern;

a partitioning member located a spaced distance from said panel and freely removably disposed within said external frame portion, said partitioning member having formed on its surface a reflective sheet made of light-reflecting material; and means for illuminating said visually perceptible part, wherein said panel comprises a first plate formed with a convexly bulging surface bonded to a flat second plate to form a continuous hollow portion between said first plate and said second plate defining said visually perceptible part.

2. A construction member comprising:

an external frame portion having connection holes formed along its periphery;

a panel removably attached to one side of said external frame portion, said panel having integrally formed on its surface a visually perceptible part in the form of a letter or pattern;

a partitioning member located a spaced distance from said panel and freely removably disposed within said external frame portion, said partitioning member having formed on its surface a reflective sheet made of light-reflecting material; and means for illuminating said visually perceptible part wherein said panel includes a first plate having a continuous through-portion defining a visually perceptible part and a transparent flat second plate bonded to one surface of said first plate to form a continuous hollow portion defining said visually perceptible part between said first plate and said second plate.

3. A construction member according to either one of claim 1 or claim 2, further comprising electrode tubes located at one end portion and the other end portion of said continuous hollow portion, and inert gases, such as neon, helium or argon, filling said continuous hollow portion, and means for applying a voltage to said electrode tubes for illuminating said visually perceptible part.

4. A construction member according to claim 1, wherein said reflective sheet is a synthetic resin film.

5. A construction member comprising:

an external frame portion having connection holes formed along its periphery;

a panel removably attached to one side of said external frame portion, said panel having integrally formed on its surface, a visually perceptible part in the form of a letter or pattern;

a partitioning member located a spaced distance form said panel and freely removably disposed within said external frame portion, said partitioning member having formed on its surface a reflective sheet made of a light-reflecting material; and means for illuminating said visually perceptible part, wherein said reflective sheet is a half mirror.

* * * * *